United States Patent [19]

Budde

[11] 4,369,707

[45] Jan. 25, 1983

[54] SHORT CIRCUIT FUSE FOR ELECTRICAL IGNITERS

[75] Inventor: Volker Budde, Grosskarlbach, Fed. Rep. of Germany

[73] Assignee: Daimler-Benz Aktiengesellschaft, Stuttgart, Fed. Rep. of Germany

[21] Appl. No.: 56,233

[22] Filed: Jul. 10, 1979

[30] Foreign Application Priority Data

Jul. 12, 1978 [DE] Fed. Rep. of Germany ..... 2830552

[51] Int. Cl.[3] ..... F42B 3/10

[52] U.S. Cl. ..... 102/202.2; 102/202.9

[58] Field of Search ..... 102/28 R, 28 P, 28 S, 102/28 EB, 203, 259

[56] References Cited

U.S. PATENT DOCUMENTS

| | | | |
|---|---|---|---|
| 1,959,479 | 5/1934 | Kielczewski | 102/28 R |
| 2,880,671 | 4/1959 | Lutz et al. | 102/28 R |
| 3,040,284 | 6/1962 | Connell | 102/28 UX |
| 3,180,263 | 4/1965 | Williams, Jr. | 102/28 R |
| 3,344,744 | 10/1967 | Bankston, Jr. | 102/28 EB |
| 3,483,312 | 12/1969 | McDonald et al. | 102/28 R X |
| 3,585,933 | 6/1971 | Kos | 102/28 R |
| 3,682,096 | 8/1972 | Ludke et al. | 102/28 R |
| 3,838,206 | 9/1974 | Eklund | 102/28 R X |

FOREIGN PATENT DOCUMENTS

| | | | |
|---|---|---|---|
| 2030483 | 11/1970 | France | 102/28 R |

*Primary Examiner*—Peter A. Nelson

*Attorney, Agent, or Firm*—Craig & Antonelli

[57] ABSTRACT

A short-circuit fuse for electrical igniters with a plug-in connection wherein the short-circuit is automatically eliminated upon a connection of the igniter to a current carrying line. At least one pin-shaped electrode, extending out of the igniter, is surrounded by a common socket with at least one contact spring, arranged at the socket and extending essentially in parallel to the at least one electrode, being normally in contact with the electrode when the igniter is unconnected to the current carrying line. The contact spring has an elongated and leaf-like shape and is electrically conductively connected with either a further contact spring or with the igniter casing. Upon a connection of the igniter to the current carrying line, the contact spring is lifted off the electrode by the insertion of a connector plug.

8 Claims, 9 Drawing Figures

FIG. 1
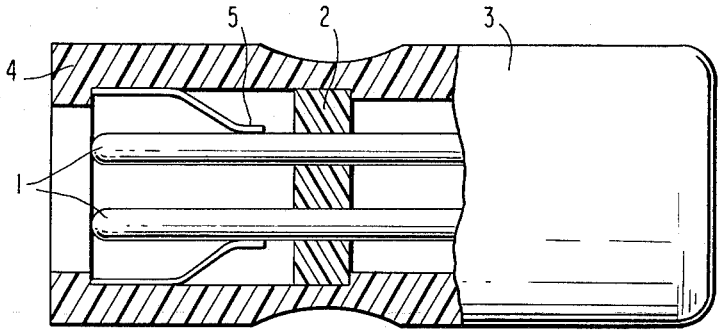
FIG. 2
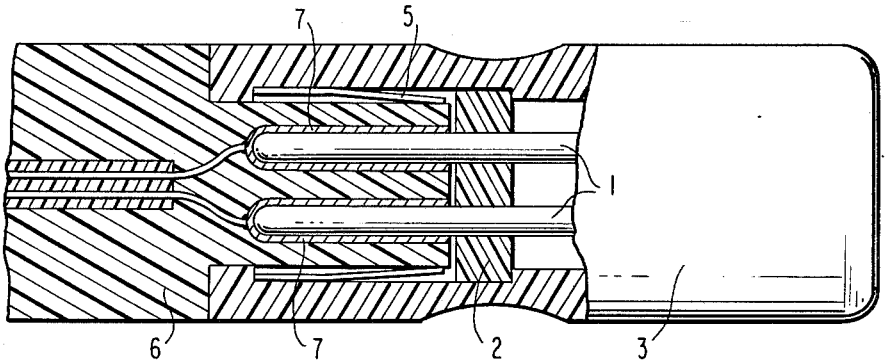
FIG. 3
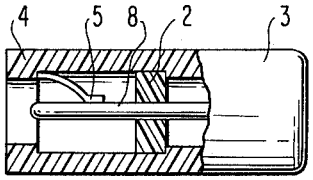
FIG. 4
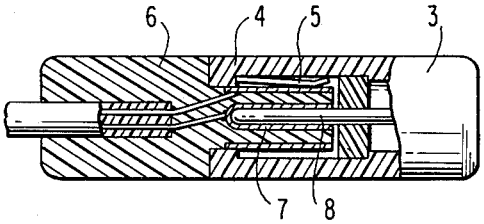
FIG. 7
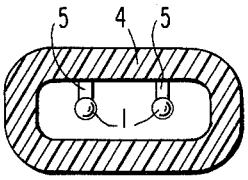
FIG. 5
FIG. 6
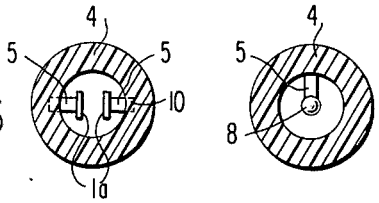
FIG. 8
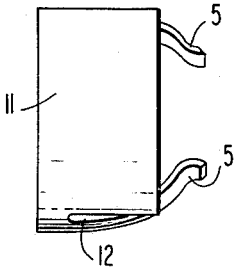
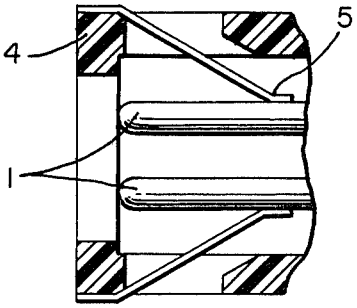
FIG. 9

SHORT CIRCUIT FUSE FOR ELECTRICAL IGNITERS

The present invention relates to a safety means and, more particularly, to an automatic short-circuit fuse for electrical igniters equipped with pins or studs with a connection to an ignition circuit being established by inserting the contact pins or studs into a corresponding socket.

Various forms of igniters have been proposed for igniting propellant or explosive charges wherein two mutually insulated current leads are connected to an igniter element, that is, an electrically conductive bridge in the form of fine metal filaments, conductive layers or semiconductive layers, or conductive explosives and priming substances.

A disadvantage of the proposed electrical igniters resides in the fact that such igniters can be triggered in an unconnected condition by means of, for example, creeping and parasitic currents, static charges, and sometimes even by electrical energy radiated by a radio transmission. This disadvantage becomes even more significant as the sensitivity of the igniter increases.

In automobiles equipped with an air bag system, a highly sensitive igniter having a correspondingly brief response time is required since, in case of a collision of the automobile with, for example, an obstacle, the igniter must effect ignition of the air bag system in fractions of a second in order to insure the inflation of the air bag to protect the occupants of the automobile before they can be thrown onto the rigid parts of the interior of the automobile.

To prevent an unintended triggering of igniters, a number of proposals have been made for short-circuiting the contacts of the igniter.

For this purpose, a metallic short-circuiting element or fuse has been proposed wherein, for example, lead seals which receive the terminal wires in bores, with the seals being stripped off from the terminal wires before the current-conducting wires are connected.

In German Pat. No. 562,732, a bracket-shaped short-circuit fuse construction is provided with the bracket-shaped fuse being severed or removed after a connection of the conductors of the igniter.

However, these proposed short-circuit fuses have a disadvantage that unsafe conditions occur, in part, already during an installation of the igniter system, and, at least, when the igniter is removed. During the existence of such unsafe conditions, an unintended explosion can readily take place. However, a removal of the igniter or of the entire airbag unit is required for testing purposes in airbag systems and, for example, with an airbag disposed in a steering wheel, it would be necessary in all cases to remove the igniter when the steering wheel must be disassembled during repair work on the automobile.

In German Pat. No. 502,758, a fuse construction is proposed wherein the short circuit is automatically eliminated when connecting the igniter to a current conducting line and is reestablished when the connection is interrupted.

However, the last-mentioned proposed fuse has a very complicated structure and, in view of the small dimensions of igniters, the required individual parts must be manufactured with extreme mechanical precision so that extremely high production costs must be incurred if the disturbances in the operation of the igniters are to be avoided.

The aim underlying the present invention essentially resides in providing an automatically operating short-circuit fuse construction for electrical igniters which construction is automatically deactivated when the igniter is connected to the ignition circuit and automatically reactivated when the igniter is disconnected from the ignition circuit.

In accordance with advantageous features of the present invention, a short-circuit fuse construction for electrical igniters is provided wherein one or more pin-shaped electrodes, extended out of the igniter and surrounded by a common socket, are in contact with contact springs arranged at the socket and extending essentially in parallel to the electrodes. The contact springs have an elongated and leaf-like shape and are electrically conductively connected with each other and, optionally, with the igniter casing. Upon connection to the ignition circuit, the contact springs are lifted off the electrodes by insertion of the connector plug.

In accordance with further advantageous features of the present invention, the leaf-shaped contact springs form a part of a spring clip sleeve made of sheet metal and are formed from the spring clip sleeve by two slots respectively extending in a side-by-side and axial relationship and by a corresponding bending of the tongues produced by the two slots.

In accordance with still further features of the present invention, the pin-shaped electrodes are extended out of the igniter to such an extent that the connection of the igniter to the circuit is effected before the contact springs are lifted off the electrodes.

Accordingly, it is an object of the present invention to provide a short-circuit fuse construction for electrical igniters which avoids, by simple means, the aforementioned shortcomings and disadvantages encountered in the prior art.

Another object of the present invention resides in providing a short-circuit fuse for electrical igniters which prevents an unintended activation of the igniter.

Yet another object of the present invention resides in providing an automatic short-circuit fuse for electrical igniters which prevents unintended activation of the igniters by environmental disturbances.

Yet another object of the present invention resides in providing a short-circuit fuse for electrical igniters which automatically eliminates the short-circuit upon a connection to a current carrying line and automatically restores the short-circuiting upon a disconnection from the current carrying line.

Another object of the present invention resides in providing a short-circuit fuse for electrical igniters which is simple in its manufacture and therefore relatively inexpensive to manufacture.

A further object of the present invention resides in providing a short-circuit fuse which safely functions reliably under all operating conditions.

These and other objects, features, and advantages of the present invention will become more apparent from the following description when taken in connection with the accompanying drawings which show, for the purposes of illustration only, one embodiment in accordance with the present invention, and wherein:

FIG. 1 is an axial cross-sectional view through an igniter with the short-circuit fuse of the present invention in an activated or safety position;

FIG. 2 is an axial cross-sectional view through an igniter with the short-circuit fuse of the present invention in a deactivated or ignition position;

FIG. 3 is an axial cross-sectional view through an igniter employing another embodiment of a short-circuit fuse in accordance with the present invention in an activated or safety position;

FIG. 4 is an axial cross-sectional view of the igniter of FIG. 3 with the short-circuit fuse of the present invention in a deactivated or ignition position;

FIGS. 5 and 6 are end views of an igniter such as illustrated in FIG. 1 with a rectangular or circularly configured casing;

FIG. 7 is an end view of the igniter of FIG. 3; and

FIG. 8 is a plan view of a spring clip sleeve from which contact spring for the short-circuit fuse of the present invention can be formed by providing two slots lying side-by-side and extending in an axial direction of the spring clip sleeve.

FIG. 9 is an axial cross-sectional view of another embodiment of the present invention wherein the springs are externally mounted on an outer circumferential surface of the socket means.

Referring now to the drawings wherein like reference numerals are used throughout the various views to designate like parts and, more particularly, to FIG. 1, according to this figure, an igniter, illustrated on a greatly enlarged scale, includes pin-shaped electrodes 1, leading to an igniter element, not illustrated in detail, constructed in a conventional manner with the two pin-shaped electrodes 1 being mutually insulated by an insulating member 2 formed of a ceramic or synthetic resinous material. The pin-shaped electrodes 1 are held in position in the igniter casing 3 by the insulating member 2. The insulating member 2 may be mounted in the igniter casing in any desired manner such as, for example, by gluing, providing a crimp, etc.

The igniter casing 3 is extended beyond the insulating member 2 in a forward direction so as to form a socket 4 projecting beyond the electrodes 1. The socket 4 serves to protect the electrodes 1 against a bending deformation and also serves as a guide means for guiding a contact or connector plug 6 (FIG. 2) and also as a mounting for contact springs 5 which effect the safety or short-circuiting action.

The contact springs 5 are fashioned so as to be leaf-shaped and extend essentially in parallel to the electrodes 1. The contact springs 5 are attached in the socket 4 by, for example, welding, gluing, or pressing into guide groove 10 (FIG. 6) or the like.

To establish a short-circuit, the contact springs, which are in contact with the electrodes 1 must also be conductively connected to each other. If the igniter casing is made of metal, the casing may, in a particularly simple meanner, serve as the conductive connection between the two contact springs 5. It is especially advantageous to utilize two mutually connected contact springs 5 joined with each other by means of, for example, a web which corresponds to a required mutual spacing of the contact tongues or lugs of the contact springs 5. In this fashion, the contact springs 5 can be produced by a one-step punching out of the springs 5 from a spring metal. A suitable material for the contact springs may be any one of the normal spring-type materials, for example, sheet steel, spring bronze, etc. Additionally, to protect the contact points of the contact springs 5 from corrosion, such points may be optionally protected by, for example, a gold-plating.

As shown in FIG. 2, the igniter is in an armed condition with the short-circuit fuse being deactivated. In the illustrated position, the connector plug 6, formed of an insulating material and containing two metal contact sockets 7, is connected to appropriate wire leads for supplying a current to the igniter. When inserting the connector plug 6, the outer surfaces of the connector plug urge the contact springs 5 off the electrodes 1 so as to eliminate the short circuit.

Preferably, the electrodes 1 are extended out of the igniter proper, beginning behind the insulating member, to such an extent that the contact between the electrodes 1 and the connector socket 7 is established at the beginning of the insertion of the connector plug 6, namely, before the contact springs 5 have been lifted off the electrodes 1. In this way, any potential differences which may exist in the lead wires are compensated for prior to the elimination of the short-circuit.

Generally, the interspace produced by the clearance between the connector plug 6 and the socket 4 is large enough to receive the contact springs 5 in the lifted off condition. However, in some instances it may be advantageous to provide recesses for receiving the springs in the socket 4 or in the connector plug 6. If necessary, the socket 4 and the connector plug 6 can be provided with grooves, lugs, and the like to guide the plug 6. Moreover, the socket 4 and plug 6 can be secured against an unintentional pulling apart by, for example, a thread and a cap nut (not shown). As shown in FIGS. 3 and 7, an igniter may be provided which includes a casing 3 and an insulating member 2 through which a central electrode or contact 8 is disposed with the igniter casing 3 and socket 4 being formed of a metallic material. In such situations, the electrode pin 8 forms one electrode with the igniter casing and socket 4 forming the other electrode.

A single contact spring 5, of a leaf-shape, extends essentially parallel to the electrode 8. In the position of FIG. 3, the igniter is short-circuited by virtue of the conductive connection between the electrode 8 and the casing 3 through the metallic contact spring 5.

As with the arrangement of FIGS. 1 and 2, as shown in FIG. 4, the electrode 8 has a sufficient axial length so as to enable the establishing of a circuit between the electrodes at the beginning of insertion of the connector plug 6 prior to the contact spring being lifted off from the electrode 8.

FIGS. 5 and 6 provide an example of the disposition of the contact springs and electrodes with igniters having rectangular or circular cross-sectional configurations. Moreover, in lieu of pin-shaped electrodes 1, as shown in FIG. 6, it is also possible to provide relatively flat prong-type electrodes 1*a*.

As shown in FIG. 8, the spring contacts may be formed from a spring clip sleeve 11. For this purpose, two axially extending spaced slots are formed in a side-by-side relationship so as to produce axially extending tongues which are then bent so as to form the respective contact springs. The assembly of such a spring sleeve is especially simple since it need merely be pressed into the socket 4 in the correct position, that is, in a position at which the contact springs will engage the respective electrodes of the igniter, with the spring sleeve being self-retaining in the socket 4 due to the spring clip effect. It is also possible to clamp the spring clip sleeve onto the exterior of the socket 4. With such an arrangement, the contact springs 5 would be extended through corresponding perforations or openings (not shown) in the socket in order to contact the electrodes.

FIG. 9 is an axial cross-sectional view of the igniter of the present invention wherein the spring clip sleeve means is disposed on an outer circumferential surface of the socket, openings being provided in the socket through which the spring contacts extend so as to engage the electrodes.

While I have shown and described several embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A short-circuit fuse for a plug-in type electrical igniter, the fuse being adapted to automatically eliminate a short-circuit upon a connection of the igniter to a current carrying lead means, characterized in that a common socket means is provided for surrounding at least one electrode extending out of the igniter, at least one elongated leaf contact spring means extending essentially in parallel to the at least one electrode is disposed in the socket means so as to normally engage the at least one electrode and short-circuit the same when the igniter is unconnected to the current carrying lead means, the at least one contact spring means is arranged in the socket so as to be lifted off the at least one electrode means upon an insertion of a circuit connector plug of the current carrying lead means into the socket means.

2. A short-circuit fuse according to claim 1, characterized in that the common socket means surrounds at least two electrodes and at least two contact spring means are disposed in the socket means so as to respectively engage one of the electrodes when the igniter is unconnected to the current carrying lead means, and in that means are provided for electrically conductively connecting each of the contact spring means to each other.

3. A short-circuit fuse according to claim 2, characterized in that said connecting means includes a sheet metal spring clip sleeve means for retaining the contact springs at the socket means, at least two pair of spaced axially extending slots are provided in the clip sleeve means for forming a pair of spaced tongues, and in that the spaced tongues are bent so as to form the respective spring contact means.

4. A short-circuit fuse according to claim 3, characterized in that the spring clip sleeve means is disposed interiorly of the socket means.

5. A short-circuit fuse according to claim 3, characterized in that the spring clip sleeve means is disposed on an outer circumferential surface of the socket means, and in that openings are provided in the socket means through which the respective spring contact means extend so as to engage the electrodes.

6. A short-circuit fuse according to one of claims 2, 3, 4 or 5, characterized in that each of the electrodes have a predetermined axial length so as to enable a connection of the igniter to the current carrying load means prior to a lifting off of the contact spring means from the respective electrodes.

7. A short-circuit fuse according to claim 1, characterized in that the common socket means is fashioned of metal so as to form a second electrode, and in that the at least one contact spring means is electrically conductively connected with the second electrode.

8. A short-circuit fuse according to claim 7, characterized in that the at least one electrode has a predetermined axial length so as to enable a connection of the igniter to the current carrying load means prior to a lifting off of the contact spring means from the respective electrodes.

* * * * *